US012723214B2

(12) United States Patent
Tanaka et al.

(10) Patent No.: US 12,723,214 B2
(45) Date of Patent: Sep. 1, 2026

(54) LUBRICATING ENGINE OIL FOR HYBRID OR PLUG-IN HYBRID ELECTRIC VEHICLES

(71) Applicants: CHEVRON JAPAN LTD., Tokyo (JP); CHEVRON ORONITE COMPANY LLC, San Ramon, CA (US)

(72) Inventors: Isao Tanaka, Makinohara City (JP); Qunlai Chen, Walnut Creek, CA (US)

(73) Assignees: CHEVRON JAPAN LTD., Tokyo (JP); CHEVRON ORONITE COMPANY LLC, San Ramon, CA (US)

( * ) Notice: Subject to any disclaimer, the term of this patent is extended or adjusted under 35 U.S.C. 154(b) by 0 days.

(21) Appl. No.: 18/836,331

(22) PCT Filed: Feb. 6, 2023

(86) PCT No.: PCT/IB2023/051048
§ 371 (c)(1),
(2) Date: Aug. 6, 2024

(87) PCT Pub. No.: WO2023/148697
PCT Pub. Date: Aug. 10, 2023

(65) Prior Publication Data

US 2025/0136888 A1 May 1, 2025

Related U.S. Application Data

(60) Provisional application No. 63/307,376, filed on Feb. 7, 2022.

(51) Int. Cl.

| | |
|---|---|
| ***C10M 139/00*** | (2006.01) |
| ***C10M 137/10*** | (2006.01) |
| *C10N 10/04* | (2006.01) |
| *C10N 10/12* | (2006.01) |
| *C10N 20/02* | (2006.01) |
| *C10N 30/04* | (2006.01) |
| *C10N 30/06* | (2006.01) |

(52) U.S. Cl.
CPC ..... *C10M 139/00* (2013.01); *C10M 2223/02* (2013.01); *C10N 2010/04* (2013.01); *C10N 2010/12* (2013.01); *C10N 2020/02* (2013.01); *C10N 2030/04* (2013.01); *C10N 2030/06* (2013.01)

(58) Field of Classification Search
CPC ..... C10M 139/00; C10M 2223/02; C10M 137/10; C10N 2010/04; C10N 2010/12; C10N 2020/02; C10N 2030/04; C10N 2030/06
See application file for complete search history.

(56) References Cited

U.S. PATENT DOCUMENTS

| | | | | |
|---|---|---|---|---|
| 4,101,428 | A | 7/1978 | Crawford | |
| 4,215,067 | A | 7/1980 | Brannen | |
| 4,263,150 | A | 4/1981 | Clason | |
| 4,495,075 | A | 1/1985 | Buckley | |
| 2012/0012076 | A1* | 1/2012 | Atkinson | C10M 169/04 123/1 A |
| 2022/0389345 | A1* | 12/2022 | Shao | C10M 125/10 |
| 2024/0191153 | A1* | 6/2024 | Burette | C10M 169/04 |

FOREIGN PATENT DOCUMENTS

| | | | |
|---|---|---|---|
| WO | 9001531 | W | 2/1990 |

OTHER PUBLICATIONS

PCT International Search Report mailed on May 12, 2023, issued in International Application No. PCT/IB2023/051048, filed on Feb. 6, 2023, 3 pages.

* cited by examiner

*Primary Examiner* — Ellen M Mcavoy

(57) ABSTRACT

The present application pertains to a lubricating oil composition for a hybrid or plug-in hybrid electric vehicle. The composition may comprise a base oil and a ZnDTP derived from a mixture of C3 and C8 alcohols.

9 Claims, No Drawings

LUBRICATING ENGINE OIL FOR HYBRID OR PLUG-IN HYBRID ELECTRIC VEHICLES

CROSS-REFERENCE TO RELATED APPLICATIONS

This application is a national phase application of PCT/IB2023/051048 filed Feb. 6, 2023, which claims the priority benefit of U.S. Provisional Application No. 63/307,376, filed Feb. 7, 2022, the disclosure of which are incorporated herein by reference.

FIELD OF THE DISCLOSURE

The present disclosure relates to lubricating oil composition for hybrid or plug-in hybrid electric vehicle.

BACKGROUND

Modern lubricating oils are formulated to exacting specifications often set by original equipment manufacturers. To meet the exacting specifications, carefully selected lubricant additives are blended together with base oils of lubricating viscosity. A typical lubricating oil composition may contain, for example, dispersants, detergents, antioxidants, wear inhibitors, rust inhibitors, corrosion inhibitors, foam inhibitors, and/or friction modifiers. The specific application or use (e.g., hybrid vehicles) governs the set of additives that goes into a lubricating oil composition.

Hybrid and/or plug-in hybrid vehicles typically rely on two distinctly different types of motive technologies—internal combustion engine and electric motor. The internal combustion engine mainly drives the vehicle at high speeds. The electric motor drives the vehicle at low speeds and can also assist the internal combustion engine when additional power is needed. It is important for hybrid vehicles to distribute power from the engine and the motor in a well-balanced manner as the vehicle speed increases.

One of distinguishing aspects of hybrid/plug-in hybrid electric vehicles is that its engines typically operate at very low temperatures compared to conventional internal combustion engines. This especially true when the hybrid/plug-in hybrid vehicle is only driven a short distance.

In general, the differences between hybrid/plug-in hybrid electric vehicles and conventional automobile vehicles are significant enough that new engine oils specifically designed for hybrid/plug-in hybrid electric engines are needed.

SUMMARY OF THE INVENTION

In an aspect, the present invention includes a lubricating oil composition for hybrid or plug-in hybrid electric vehicle, comprising: a base oil; and ZnDTP derived from a mixture of C3 and C8 alcohols.

In another aspect, the present invention includes a method for improving performance of a hybrid or plug-in hybrid electric vehicle, the method comprising: lubricating a hybrid or plug-in hybrid electric vehicle with a lubricating oil composition comprising: a base oil; and ZnDTP derived from a mixture of C3 and C8 alcohols.

DETAILED DESCRIPTION

Definitions

The following terms will be used throughout the specification and will have the following meanings unless otherwise indicated.

The term "a major amount" of oil of lubricating viscosity refers to where the amount of base oil is at least 40 wt. % of the lubricating oil composition. In some embodiments, "a major amount" refers to an amount of the base oil more than 50 wt. %, more than 60 wt. %, more than 70 wt. %, more than 80 wt. %, or more than 90 wt. % of the lubricating oil composition.

The term "internal combustion engine" refers to any engine in which the combustion of a fuel occurs with an oxidizer in a combustion chamber which is a component of a working fluid flow circuit. Internal combustion engines are employed in hybrid vehicles and often operate at lower temperatures than internal combustion engines on traditional vehicles.

The present disclosure provides a lubricating oil composition that is designed to be used in hybrid or plug-in hybrid electric vehicles. In one aspect, the lubricating oil of the present invention can improve fuel efficiency of hybrid or plug-in hybrid electric engine. In another aspect, the lubricating oil composition can improve boundary friction control at lower engine operating temperatures typically seen in hybrid or plug-in hybrid electric vehicles.

In yet another aspect, the present disclosure provides a lubricating oil composition that includes phosphorus/sulfur-containing additive wherein the lubricating oil composition provides high fuel economy while maintaining good oxidation performance. Fuel economy and oxidation performance are often considered tradeoffs when formulating lubricating oils.

The Oil of Lubricating Viscosity

The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "Chemistry and Technology of Lubricants," 2nd Edition, London, Springer, Chapters 1 and 2 (1996); and A. Sequeria, Jr., "Lubricant Base Oil and Wax Processing," New York, Marcel Decker, Chapter 6, (1994); and D. V. Brock, Lubrication Engineering, Vol. 43, pages 184-5, (1987), all of which are incorporated herein by reference.

Generally, the amount of the base oil in the lubricating oil composition is a "a major amount" of oil of lubricating viscosity as defined above.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process.

In some embodiments, the base oil has a kinematic viscosity at 100° C. from about 2.5 centistokes (cSt) to about 20 cSt, from about 4 centistokes (cSt) to about 20 cSt, or from about 5 cSt to about 16 cSt. The kinematic viscosity of the base oils or the lubricating oil compositions disclosed herein can be measured according to ASTM D 445, which is incorporated by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises one or more of the base stocks in one or more of Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

In some embodiments, the base oil comprises one or more of the base stocks in Group I, II, III, IV, V or a combination thereof. In other embodiments, the base oil comprises one or more of the base stocks in Group II, III, IV or a combination thereof.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyakyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 2 to about 30, from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 to about 15, from about 3 to about 12, or from about 4 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Phosphorus/Sulfur-Containing Additives

The lubricating oil composition of the present invention includes one or more phosphorus/sulfur-containing additives. In an embodiment, the one or more phosphorus/sulfur-containing additives include zinc dithiophosphate (ZnDTP) which is also often referred to as zinc dihydrocarbyldithiophosphate (ZDDP). These phosphorus/sulfur-containing compounds are derived from a mixture of C3 and C8 alcohols. Without being limited by theory, it is believed that the specific combination of the alcohols described herein leads to the desirable performance characteristics demonstrated in the Examples.

In general, phosphorus/sulfur-containing additive is present in the lubricating oil composition in an amount necessary to provide a desirable performance benefit. The lubricating oil composition of the present invention may comprise phosphorus/sulfur-containing additive in an amount that provides about 100 to about 2000 ppm of phosphorus to the lubricating oil composition, such as from about 200 to about 1900 ppm, from about 300 to about 1800 ppm, from about 400 to about 1700 ppm, from about 500 to about 1600 ppm, from about 600 to about 1500 ppm, from about 100 to about 1900 ppm, from about 100 to about 1800 ppm, from about 100 to about 1700 ppm, from about 100 to about 1600 ppm, from about 100 to about 1500 ppm, from about 200 to about 2000 ppm, from about 200 to about 1800 ppm, from about 200 to about 1700 ppm, from about 200 to about 1600 ppm, from about 200 to about 1500 ppm, from about 300 to about 2000 ppm, from about 300 to about 1900 ppm, from about 300 to about 1700 ppm, from about 300 to about 1600 ppm, from about 300 to about 1500 ppm, from about 400 to about 2000 ppm, from about 400 to about 1900 ppm, from about 400 to about 1800 ppm, from about 400 to about 1600 ppm, from about 400 to about 1500 ppm, from about 500 to about 2000 ppm, from about 500 to about 1900 ppm, from about 500 to about 1800 ppm, from about 500 to about 1700 ppm, and from about 500 to about 1500 ppm.

Suitable zinc dithiophosphate (ZnDTP) can have the following formula:

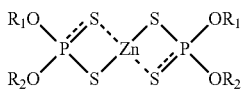

wherein $R^1$ and $R^2$ are alkyl groups having 3 or 8 carbon atoms, wherein at least one of $R^1$ or $R^2$ has 3 carbon atoms and at least one of $R^1$ or $R^2$ has 8 carbon atoms. Illustrative examples of the alkyl groups include n-propyl, isopropyl, n-octyl, isooctyl, 2-octyl, 3-octyl, 4-octyl, methylheptyl, 2-ethylhexyl, dimethylhexyl, cyclohexylethyl, ethylcyclohexyl, and vinylhexyl groups.

Zinc dithiophosphates are coordination compounds that can be synthesized from phosphorodithioic acids from which metal salts can be prepared. Examples of dihydrocarbyl phosphorodithioic acids and zinc salts, and processes for preparing such acids and salts are found in, for example, U.S. Pat. Nos. 4,101,428; 4,215,067; 4,263,150; and 4,495,075. These patents are hereby incorporated by reference for such disclosures.

The phosphorodithioic or dithiophosphoric acids are typically prepared by the reaction of phosphorous pentasulfide with an alcohol or phenol or mixtures of alcohols and/or phenols. The reaction involves at least four moles of the alcohol or phenol per mole of phosphorous pentasulfide, and may be carried out within the temperature range from about 50° C. to about 200° C. Thus, the preparation of O,O-di-(isopropyl/2-ethylhexyl) phosphorodithioic acid involves the reaction of phosphorous pentasulfide with at least four moles of a mixture of isopropanol and 2-ethylhexanol at about 100° C. for up to 5 hours. Hydrogen sulfide is liberated and the residue is the defined acid. The preparation of the zinc salt of this acid may be by reaction with zinc oxide in the presence of a promoter (for example acetic acid) at elevated reaction temperature and extended reaction period.

When derived from alkyl alcohols, the zinc dithiophosphate can also be referred to as zinc dialkyldithiophosphate. Depending on the nature of the alcohols, the zinc dialkyldithiophosphate can be a primary or secondary zinc dialkyldithiophosphate or mixtures thereof.

The R groups (i.e., $R^1$, $R^2$, etc.) are derived from a mixture of alcohols having either 3 or 8 carbon atoms. The mixture comprises a specific ratio of C3 to C8 alcohols. Suitable ratios can range from about 95/5 molar ratio of C3 to C8 alcohols down to about 5/95 of C3 to C8 alcohols, such as a 90/10 ratio of C3 to C8 alcohols, 85/15 ratio of C3 to C8 alcohols, 80/20 ratio of C3 to C8 alcohols, 75/25 ratio of C3 to C8 alcohols, 70/30 ratio of C3 to C8 alcohols, 60/40 ratio of C3 to C8 alcohols, 50/50 ratio of C3 to C8 alcohols, 40/60 ratio of C3 to C8 alcohols, 30/70 ratio to C3 to C8 alcohols, 25/75 ratio of C3 to C8 alcohols, 20/80 ratio of C3 to C8 alcohols, 10/90 ratio of C3 to C8 alcohols and so forth.

Other Properties of the Lubrication Oil Compositions

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade such as the following: 0W, 0W-8, 0W-12, 0W-16, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Other Additives

To the extent that it is consistent with the ingredients and properties of the lubricating composition described above, the lubricating oil composition may further comprise an additive that can impart or improve any desirable property of the lubricating oil composition. Any additive known to a person of ordinary skill in the art may be used in the lubricating oil compositions disclosed herein. Some suitable additives have been described in Mortier et al., "Chemistry and Technology of Lubricants," 2nd Edition. London, Springer, (1996); and Leslie R. Rudnick, "Lubricant Additives: Chemistry and Applications," New York, Marcel Dekker (2003), both of which are incorporated herein by reference. In some embodiments, the additive can be selected from the group consisting of antioxidants, antiwear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof.

Dispersants

Optionally, the lubricating oil composition disclosed herein can further comprise a dispersant. Dispersants maintain in suspension materials resulting from oxidation during engine operation that are insoluble in oil, thus preventing sludge flocculation and precipitation or deposition on metal parts. Dispersants useful herein include nitrogen-containing, ashless (metal-free) dispersants known to effective to reduce formation of deposits upon use in gasoline and diesel engines. Suitable dispersants include hydrocarbyl succinimides, hydrocarbyl succinimides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also suitable are condensation products of polyamines and hydrocarbyl-substituted phenyl acids. Mixtures of these dispersants can also be used.

Basic nitrogen-containing ashless dispersants are well-known lubricating oil additives and methods for their preparation are extensively described in the patent literature. Preferred dispersants are the alkenyl succinimides and succinimides where the alkenyl-substituent is a long-chain of preferably greater than 40 carbon atoms. These materials are readily made by reacting a hydrocarbyl-substituted dicarboxylic acid material with a molecule containing amine functionality. Examples of suitable amines are polyamines such as polyalkylene polyamines, hydroxy-substituted polyamines and polyoxyalkylene polyamines. As is known in the art, the dispersants may be post-treated (e.g., with a boronating agent, ethylene carbonate, or a cyclic carbonate). Nitrogen-containing ashless (metal-free) dispersants are basic and contribute to the TBN of a lubricating oil composition to which they are added, without introducing additional sulfated ash. Dispersants may be present at 0.1 to 10 wt. % (e.g., 0.5 to 8, 0.7 to 7, 0.7 to 6, 0.7 to 6, 0.7 to 5, 0.7 to 4 wt. %), based on an actives level, of the lubricating oil composition. Nitrogen from the dispersants is present from greater than 0.0050 to 0.30 wt. % (e.g., greater than 0.0050 to 0.10 wt. %, 0.0050 to 0.080 wt. %, 0.0050 to 0.060 wt. %, 0.0050 to 0.050 wt. %, 0.0050 to 0.040 wt. %, 0.0050 to 0.030 wt. %) based on the weight of the dispersants in the finished oil.

Antioxidants

Optionally, the lubricating oil composition disclosed herein can further comprise an additional antioxidant that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines, phenyl-.alpha.-naphthylamine, alkyl or aralkyl substituted phenyl-.alpha.-naphthylamine, alkylated p-phenylene diamines, tetramethyldiaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, such as from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York. Marcel Dekker, Chapter 1, pages 1-28 (2003), which is incorporated herein by reference.

Friction Modifiers

The lubricating oil composition disclosed herein can optionally comprise a friction modifier that can lower the friction between moving parts. Any friction modifier known by a person of ordinary skill in the art may be used in the lubricating oil composition. Non-limiting examples of suitable friction modifiers include fatty carboxylic acids: derivatives (e.g., alcohol, esters, borated esters, amides, metal salts and the like) of fatty carboxylic acid; mono-, di- or tri-alkyl substituted phosphoric acids or phosphonic acids; derivatives (e.g. esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments, the friction modifier may be aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, or fatty tertiary amines, wherein the aliphatic or fatty group contains more than about eight carbon atoms so as to render the compound suitably oil soluble.

The amount of the friction modifier may vary from about 0.01 wt. % to about 10 wt %, from about 0.05 wt,% to about 5 wt,%, or from about 0.1 wt. % to about 3 wt,%, based on the total weight of the lubricating oil composition. Some suitable friction modifiers have been described in Mortier et al., "Chemistry and Technology of Lubricants," 2nd Edition, London, Springer, Chapter 6, pages 183-187 (1996); and Leslie R, Rudnick, "Lubricant Additives: Chemistry and Applications," New York, Marcel Dekker, Chapters 6 and 7, pages 171-222 (2003)

The lubricating oil composition of the present invention preferably further contains molybdenum compounds in an amount that provides about 10 to 2500 ppm of molybdenum to the lubricating oil composition. These compounds give sulfated ash and may have a sulfur content accordingly, the amounts of these compounds are controlled in view of the various component contents and the desired characteristics.

The molybdenum compound can function as a friction modifier, an oxidation inhibitor, and an anti-wear agent in the lubricating oil composition of the present invention, and further imparts increased high temperature detergency to the lubricating oil composition. The content of the molybdenum compound in the lubricating oil composition of the present invention preferably is in an amount of 10 to 2,500 ppm in terms of the molybdenum element content. Examples of the molybdenum compounds include a sulfur-containing oxymolybdenum succinic imide complex compound, an oxymolybdenum dithiocarbamate sulfide, oxymolybdenum dithiophosphate sulfide, amine-molybdenum complex compound, oxymolybdenum diethylate amide, and oxymolybdenum monoglyceride.

Pour Point Depressants

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "Chemistry and Technology of Lubricants," 2nd Edition, London, Springer, Chapter 6, pages 187-189 (1996); and Leslie R. Rudnick, "Lubricant Additives: Chemistry and Applications," New York, Marcel Dekker, Chapter 11, pages 329-354 (2003), both of which are incorporated herein by reference.

Demulsifiers

The lubricating oil composition disclosed herein can optionally comprise a demulsifier that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof.

The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "Chemistry and Technology of Lubricants," 2nd Edition. London, Springer, Chapter 6, pages 190-193 (1996), which is incorporated herein by reference.

Foam Inhibitors

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-foams have been described in Mortier et al., "Chemistry and Technology of Lubricants," 2nd Edition, London, Springer, Chapter 6, pages 190-193 (1996), which is incorporated herein by reference.

Corrosion Inhibitors

The lubricating oil composition disclosed herein can optionally comprise a corrosion inhibitor that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "Chemistry and Technology of Lubricants," 2nd Edition, London, Springer, Chapter 6, pages 193-196 (1996), which is incorporated herein by reference.

Extreme Pressure Agents

The lubricating oil composition disclosed herein can optionally comprise an extreme pressure (EP) agent that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "Lubricant Additives: Chemistry and Applications," New York, Marcel Dekker, Chapter 8, pages 223-258 (2003), which is incorporated herein by reference.

Rust Inhibitors

The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha, omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

Multifunctional Additives

In some embodiments, the lubricating oil composition comprises at least a multifunctional additive. Some non-limiting examples of suitable multifunctional additives include sulfurized oxymolybdenum organophosphorodithioate, oxymolybdenum monoglyceride, oxymolybdenum diethylate amide, amine-molybdenum complex compound, and sulfur-containing molybdenum complex compound.

Viscosity Modifiers

In certain embodiments, the lubricating oil composition comprises at least a viscosity modifier. Some non-limiting examples of suitable viscosity modifiers include polymethacrylate type polymers, ethylene-propylene copolymers, styrene-isoprene copolymers, hydrated styrene-isoprene copolymers, polyisobutylene, and dispersant type viscosity modifiers.

Metal Deactivators

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

Additive Concentrate Formulations

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

Generally, it is desired that the diluent readily solubilizes the lubricating oil soluble additive and provides an oil additive concentrate that is readily soluble in the lubricant base oil stocks or fuels. In addition, it is desired that the diluent not introduce any undesirable characteristics, including, for example, high volatility, high viscosity, and impurities such as heteroatoms, to the lubricant base oil stocks and thus, ultimately to the finished lubricant or fuel.

The present application further provides an oil soluble additive concentrate composition comprising an inert diluent and from 2.0% to 90% by weight, preferably 10% to 50% by weight based on the total concentrate, of an oil soluble additive composition according to the present application.

The following examples are presented to exemplify embodiments but are not intended to limit the application to the specific embodiments set forth. Unless indicated to the contrary, all parts and percentages are by weight. All numerical values are approximate. When numerical ranges are given, it should be understood that embodiments outside the stated ranges may still fall within the scope of the application. Specific details described in each example should not be construed as necessary features.

Examples

The following examples are intended for illustrative purposes only and do not limit in any way the scope.

As an illustrative example, the preparation of ZnDTP derived from C3/C8 alcohol (50/50 mole % ratio) is described herein.

A 50/50 mole ratio mixture of C3/C8 alcohol was prepared with 67 grams of isopropanol and 145 grams of 2-ethylhexanol. 102 grams of base oil and 110 grams of phosphoric pentasulfide were added to a 500 ml jacketed glass reactor connected to a scrubber filled with 25% of sodium hydroxide solution. The reactor was equipped with agitation and venting system. 212 grams of C3/C8 alcohol (from above) was charged to the agitated reactor in 1.5 hours.

Since the reaction between phosphoric pentasulfide and alcohol is exothermic, it is important to maintain the reactor at 70° C. (a Julabo pump was used). The reactor was blanketed by nitrogen. The liberated hydrogen sulfide was absorbed by the sodium hydroxide solution in the scrubber. After addition of alcohol, the reactor was held at 70° C. for 3 hours to allow the complete consumption of phosphoric pentasulfide. The obtained O,O-di-(isopropyl/2-ethylhexyl) dithiophosphoric acid (DTPA) was a dark greenish liquid.

240 grams of DTPA (from above) was charged to a 500 ml jacketed glass reactor, followed by the addition of a promoter (0.4 gram of acetic acid). To this agitated reactor, 41 grams of zinc oxide was charged while keeping the reactor temperature below 70° C.

Another 120 grams of the DTPA was then charged to the reactor in 1 hour. Once the addition of the DTPA was completed, the reactor was held at 70° C. for 3 hours to allow the completion of the neutralization of DTPA by zinc oxide. After 3 hours, the reaction mixture was heated to approximately 98° C. and vacuum was applied for 30 minutes to strip off any water and unreacted alcohol.

The obtained crude zinc di-(isopropyl/2-ethylhexyl)dithiophosphate (C3/C8 ZnDTP) contains small amount of unreacted zinc oxide and other sediments, which were removed by filtration. The ICP analysis showed that this C3/C8 ZnDTP contains: 7.0 wt % P; 7.7 wt % Zn and 14.1 wt % S.

Lubricating oil samples were formulated using ZnDTP derived from mixtures of alkyl alcohols as described below: The baseline formulation (0W-16) contained the following:

(1) ethylene carbonate post-treated bis-succinimide;
(2) HOB Calcium Carboxylate prepared in substantially the same manner as in U.S. Pat. No. 8,993,499. Ca amount is adjusted at 0.16 wt %.
(3) hindered phenol antioxidant;
(4) PMA comb polymer, Viscoplex® 3-162 (available from Evonik Industries AG);

(5) MoDTC compound in 0.07 wt. % of molybdenum, Sakura-lube 525 (available from ADEKA CORPORATION);

(6) foam inhibitor;

(7) ZnDTP derived from various alcohols; and (8) the remainder Group III base oil.

Table 1 summarizes comparative examples including the alcohols used to synthesize the ZnDTP additive and performance results. Table 2 summarizes the inventive examples including the alcohols used to synthesize the ZnDTP additive and performance results. For MTM and ISOT TAN tests, lower values indicate better performance.

TABLE 1

| | Comp Ex1 | Comp Ex2 | Comp Ex3 | Comp Ex4 |
|---|---|---|---|---|
| Alcohols used | C4/C6 | C8 | C3/C4 | C3/C6 |
| Total Phosphorous from ZnDTP (ppm) | 770 | 770 | 770 | 770 |
| MTM Friction Change in % (vs Comp Ex1) | 0.0 | 32.6 | −18.4 | −22.6 |
| ISOT TAN change in mg KOH/g (vs Comp Ex1) | 0.00 | −0.12 | 1.17 | 1.48 |

TABLE 2

| | Ex1 | Ex2 | Ex3 | Ex4 |
|---|---|---|---|---|
| Alcohols used | C3/C8 | C3/C8 | C3/C8 | C3/C8 |
| mole ratio % (C3 to C8) | 77/23 | 50/50 | 37/63 | 15/85 |
| Total Phosphorous from ZnDTP (ppm) | 770 | 770 | 770 | 770 |
| MTM Friction Change in % (vs Comp Ex1) | −15.7 | −21.4 | −24.5 | −9.7 |
| ISOT TAN Change in mg KOH/g (vs Comp Ex1) | −0.18 | −0.42 | −0.42 | −0.44 |

Evaluation of Thermal Stability at High Temperatures

Thermal stability at high temperatures was evaluated using the JIS (Japanese Industrial Standard) K2514 ISOT (Indiana Stirred Oxidation Test). This test was used to determine the oxidation stability of a lubricating oil composition in the presence of copper and steel.

ISOT test was performed under the following conditions:

Amount of oil: 250 mL;

Temperature of the test oil: 165.5° C.;

Test period: continuous operation for 96 hours.

Test results are determined and expressed as follows:

TAN change (ATSM D664): TAN increase is determined by subtracting the initial TAN from the end of test TAN.

MTM Friction Test

Mini Traction Machine (MTM) was employed to evaluate friction performance. MTM is a ball-on-disc type tribomachine which can measure friction properties of lubricants under a wide range of sliding-rolling conditions by controlling sliding and rolling speeds separately. The test specimens are a 19.05 mm diameter ball and a 46 mm diameter disc which are made of 52100 steel with hardness 720-780 VPN.

Friction measurements were conducted with the following conditions

Temperature of the test oil: 60° C.

Applied load of 37N

SRR (slide-roll ratio) at 20%, 50% and 150%

Entrainment speed for Stribeck measurements starting from 3000 mm/s decreasing down to 2 mm/s, consisting of 36 data points. The measurement starts from SRR at 20% followed by 50% and 150%. In order to simulate actual engine condition and properly precondition the metal surface, above sequence was repeated 12 times, drawing 36 stribeck curves in total.

The final boundary friction result was provided according to cumulative area calculated between entrainment speed 2 and 10 mm/s in the last Stribeck curve at SRR 150% ($36^{th}$) using the following formula:

$$\text{Boundary Friction} = \sum\left(\left((CoFi + CoFi + 1)/2\right) \times \text{abs}(\text{Log}(\text{Entrainment speed } i + 1) - \text{Log}(\text{Entrainment speed } i))\right)$$

wherein

Entrainment Speed $i = i^{th}$ Entrainment speed

Entrainment Speed $i+1 = (i+1)^{th}$ Entrainment speed

CoFi=Friction coefficient at $i^{th}$ Entrainment speed

CoFi+1=Friction coefficient at $(i+1)^{th}$ Entrainment speed

The ISOT and MTM test results demonstrate improved boundary friction at lower operation temperature which indicates high fuel economy while maintaining good oxidation stability.

It will be understood that various modifications may be made to the embodiments disclosed herein. Therefore the above description should not be construed as limiting, but merely as exemplifications of preferred embodiments. For example, the functions described above and implemented for operating are for illustration purposes only. Other arrangements and methods may be implemented by those skilled in the art without departing from the scope and spirit of this application. Moreover, those skilled in the art will envision other modifications within the scope and spirit of the claims appended hereto.

The invention claimed is:

1. A method for improving performance of a hybrid or plug-in hybrid electric vehicle, the method comprising:

lubricating a hybrid or plug-in hybrid electric vehicle with a lubricating oil composition comprising:

a base oil; and

ZnDTP derived from a mixture of C3 and C8 alcohols.

2. The method of claim 1 wherein the mixture has a C3 molar percentage of 30% or greater.

3. The method of claim 1 wherein the lubricating oil composition further comprises a molybdenum friction modifier.

4. The method of claim 3 wherein the molybdenum friction modifier is a molybdenum dithiocarbamate.

5. The method of claim 3 wherein the molybdenum friction modifier is present in an amount that provides about 10 to about 2500 ppm of molybdenum to the lubricating oil composition.

6. The method of claim 1 wherein the ZnDTP is present in an amount that provides about 100 to about 2000 ppm of phosphorus to the lubricating oil composition.

7. The method of claim 1 wherein the lubricating oil composition further comprises dispersant, detergent, anti-wear agent, or viscosity modifier.

8. The method of claim 1 wherein the ZnDTP has the following structure:

$$Zn[S—P(=S)(OR^1)(OR^2)]_2$$

wherein $R^1$ and $R^2$ may be the same of different hydrocarbyl radicals having 3 or 8 carbon atoms.

9. The method of claim 1 wherein the mixture of C3 and C8 alcohols have a ratio of $C_3$ to $C_8$ alcohols ranging from about 95/5 to about 5/95.

* * * * *